US006330800B1

(12) United States Patent
Price et al.

(10) Patent No.: US 6,330,800 B1
(45) Date of Patent: Dec. 18, 2001

(54) APPARATUS AND METHOD FOR ACHIEVING TEMPERATURE STABILITY IN A TWO-STAGE CRYOCOOLER

(75) Inventors: Kenneth D. Price, Long Beach; Carl S. Kirkconnell, Huntington Beach, both of CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/610,557

(22) Filed: Jul. 5, 2000

Related U.S. Application Data

(63) Continuation-in-part of application No. 09/292,028, filed on Apr. 16, 1999, now Pat. No. 6,167,707.

(51) Int. Cl.[7] ..... F25B 9/00
(52) U.S. Cl. ..... 62/6; 60/520
(58) Field of Search ..... 62/6; 60/520

(56) References Cited

U.S. PATENT DOCUMENTS 4,711,650 12/1987 Faria et al. .
5,519,999 5/1996 Harpole et al. .
5,613,365 3/1997 Mastrup et al. .
5,647,219 7/1997 Rattray et al. .
5,689,959 * 11/1997 Yatsuzuka et al. ..... 62/6
5,920,133 7/1999 Penswick et al. .

* cited by examiner

*Primary Examiner*—Ronald Capossela
(74) *Attorney, Agent, or Firm*—Colin M. Raufer; Leonard A. Alkov; Glenn H. Lenzen, Jr.

(57) ABSTRACT

A hybrid two-stage cryocooler includes a first-stage Stirling expander having a first-stage interface and a Stirling expander outlet, a thermal-energy storage device in thermal communication with first-stage interface, and a second-stage pulse tube expander with a pulse tube inlet. A gas flow path extends between the Stirling expander outlet and the pulse tube inlet, and a heat exchanger is in thermal contact with the gas flow path. The relative cooling power of the first and second stages may be controlled to increase the cooling power of the second stage relative to the first stage in response to an increased heat load to the second stage. The thermal-energy storage device acts as a thermal buffer during this period, and is later cooled when the relative cooling power is adjusted to increase the cooling power of the first stage.

15 Claims, 5 Drawing Sheets

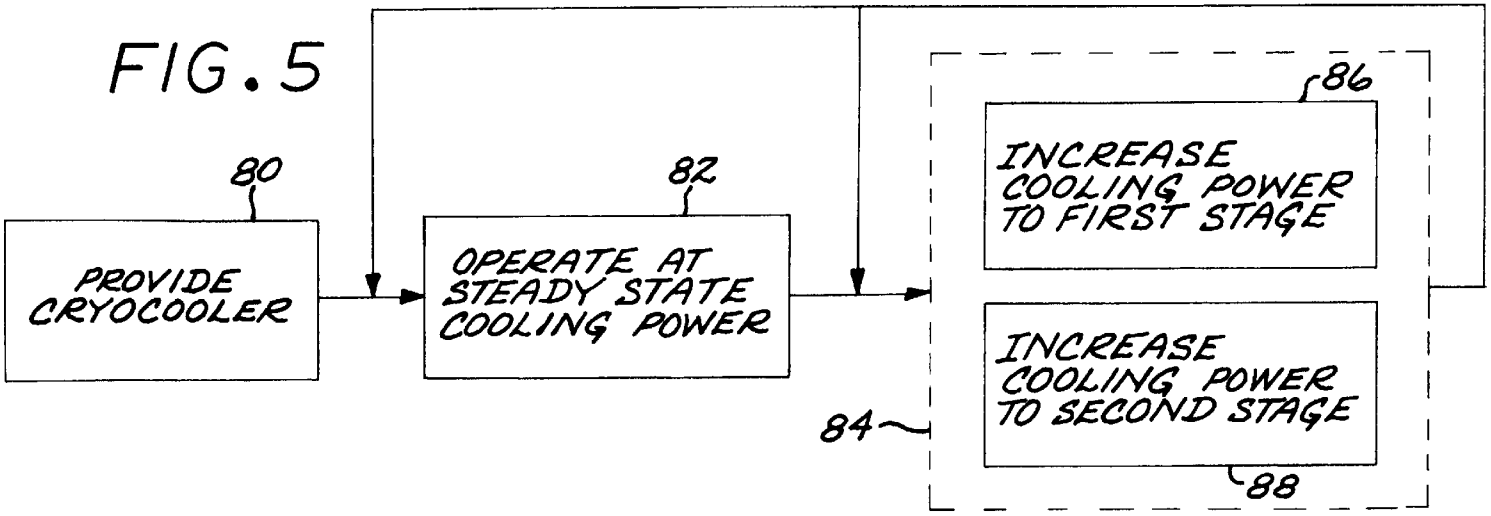
FIG. 5
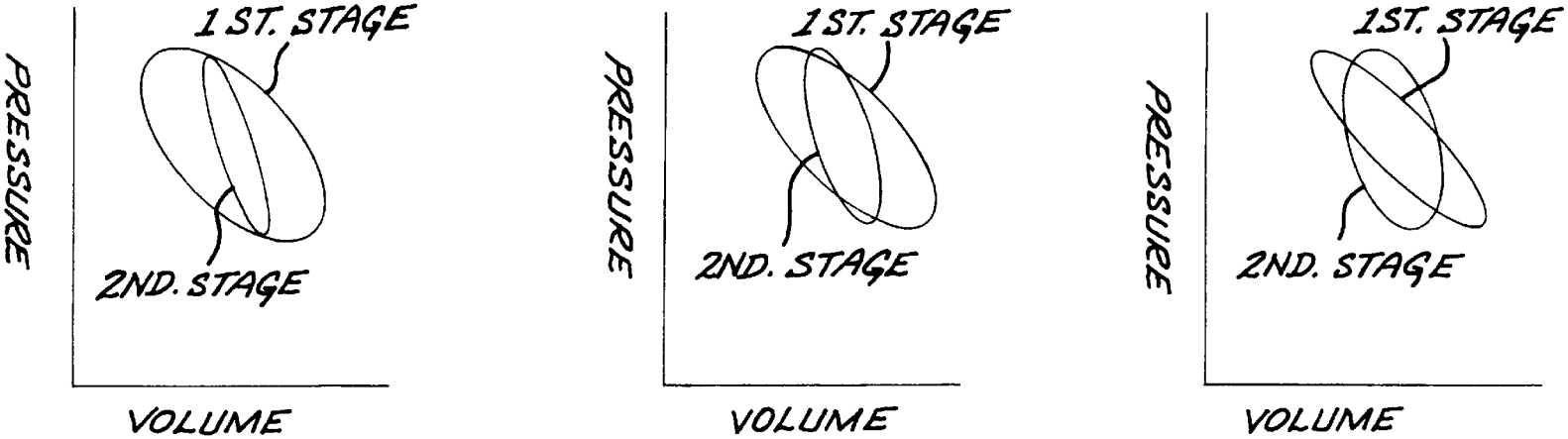
FIG. 6A
FIG. 6B
FIG. 6C

APPARATUS AND METHOD FOR ACHIEVING TEMPERATURE STABILITY IN A TWO-STAGE CRYOCOOLER

This application is a continuation-in-part of pending application Ser. No. 09/292,028, filed Apr. 16, 1999, now U.S. Pat. No. 6,167,707, for which priority is claimed and whose disclosure is incorporated by reference.

This invention relates to a cryocooler and, more particularly, to a two-stage cryocooler whose heat loading varies during operation and which is to be thermally stabilized.

BACKGROUND OF THE INVENTION

Some sensors and other components of spacecraft and aircraft must be cooled to cryogenic temperatures of about 77° K or less to function properly. A number of approaches are available, including thermal contact to liquefied gases and cryogenic refrigerators, usually termed cryocoolers. The use of a liquefied gas is ordinarily limited to short-term missions. Cryocoolers typically function by the expansion of a gas, which absorbs heat from the surroundings. Intermediate temperatures in the cooled component may be reached using a single-stage expansion. To reach colder temperatures required for the operation of some sensors, such as about 40° K or less, a multiple-stage expansion cooler may be used. The present inventors are concerned with applications requiring continuous cooling to such very low temperatures over extended periods of time.

One of the problems encountered in some applications is that the total heat load which must be removed by the cryocooler, from the object being cooled and due to heat leakage, may vary over wide ranges during normal and abnormal operating conditions. The heat loading is normally at a steady-state level, but it occasionally peaks to higher levels before falling back to the steady-state level. The cryocooler must be capable of maintaining the component being cooled at its required operating temperature, regardless of this variation in heat loading and the temporary high levels. While it handles this variation in heat loading, the cryocooler desirably would draw a roughly constant power level, so that there are not wide swings in the power requirements that would necessitate designing the power source to accommodate the variation.

One possible solution to the problem is to size the cryocooler to handle the maximum possible heat loading. This solution has the drawback that the cryocooler is built larger than necessary for steady-state conditions, adding unnecessarily to the size and weight of the vehicle. Such an oversize cryocooler also would require a power level that varies widely responsive to the variations in heat loading.

There is a need for an improved approach to the cooling of sensors and other components to very low temperatures. The present invention fulfills this need, and further provides related advantages.

SUMMARY OF THE INVENTION

The present invention provides a cryocooler which cools a component to a low temperature while accommodating wide variations in the heat loading. The cryocooler is sized to the steady-state heat loading requirement, not the maximum heat loading requirement. It continuously draws power at about the level required to maintain the component at the required temperature with the steady-state heat loading, although some variation is permitted, while it accommodates the variations in heat loading.

In accordance with the invention, a hybrid two-stage cryocooler comprises a first-stage Stirling expander having a first-stage interface and a Stirling expander outlet, a second-stage pulse tube expander having a pulse tube inlet, a gas flow path extending between the Stirling expander outlet and the pulse tube inlet, and a heat exchanger in thermal contact with the gas flow path. A thermal-energy storage device is in thermal communication with the first-stage interface. The thermal-energy storage device may be of any operable type, and preferably is a triple-point cooler. The triple-point cooler may utilize any operable working fluid, such as nitrogen, argon, methane, or neon.

The first-stage Stirling expander preferably has an expansion volume having an expander inlet, a first-stage regenerator, and the Stirling expander outlet, a displacer which forces a working gas through the expander inlet, into the expansion volume, and thence into the gas flow path, and a motor that drives the displacer. There is a motor controller for the motor, and the motor controller is operable to alter at least one of the stroke and the phase angle of the displacer (where the displacer phase is measured against pressure).

The pulse tube expander preferably comprises a pulse tube inlet, and a pulse tube gas volume in gaseous communication with the pulse tube inlet. The pulse tube gas volume includes a second-stage regenerator, a pulse tube gas column, a flow restriction, and a surge tank. A second-stage heat exchanger is in thermal communication with the second-stage regenerator and the pulse tube gas column.

Thus, most preferably, a hybrid two-stage cryocooler comprises a first-stage Stirling expander comprising an expansion volume having an expander inlet, a first-stage regenerator, and an outlet, and a displacer which forces a working gas through the expander inlet and into the expansion volume. There is a thermal-energy storage device in thermal communication with the expansion volume of the first-stage Stirling expander. A second-stage pulse tube expander comprises a pulse tube inlet, a pulse tube gas volume in gaseous communication with the pulse tube inlet, the gas volume including a second-stage regenerator, a pulse tube gas column, a flow restriction, and a surge tank, and a second-stage heat exchanger in thermal communication with the second-stage regenerator and the pulse tube gas column. A gas flow path establishes gaseous communication between the outlet of the expansion volume of the Stirling expander and the pulse tube inlet, and a flow-through heat exchanger is disposed along the gas flow path between the output of the expansion volume of the Stirling expander and the pulse tube inlet.

This multistage cryocooler has the ability to allocate cooling power between the first-stage Stirling expander and the second-stage pulse tube expander by the manner of operation of the motor that drives the displacer of the first-stage Stirling expander. If an increased heat loading is sensed, the motor allocates increased cooling power to the second-stage pulse tube expander so that the component being cooled is retained within its temperature requirements. The cooling power to the first-stage Stirling expander is reduced, but the thermal-energy storage device temporarily absorbs that portion of the heat at the hot end of the second-stage pulse tube expander which cannot be removed by the first-stage Stirling expander operating with reduced cooling power. When the heat loading on the second-stage pulse tube expander returns back to more nearly steady-state levels, the cooling power is reallocated from the second-stage pulse tube expander to the first-stage Stirling expander, which removes the temporarily stored heat from the thermal-energy storage device to restore and prepare it for subsequent thermal loading peaks. Throughout these cycles, the power level consumed by the cryocooler remains approximately constant, although the cooling power is reallocated as necessary.

The present invention thus provides an advance over conventional cryocoolers. The cryocooler of the invention is sized to a steady-state heat loading requirement, and the thermal-energy storage device acts as a buffer. Significantly, the thermal-energy storage device stabilizes the cryocooler at the first-stage Stirling expander, while maintaining the temperature within operating limits at the heat load of the second-stage pulse tube expander. The thermal-energy storage device thus functions at a substantially higher temperature than the cooled component, but allows the temperature of the cooled component to remain approximately constant.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 5 is a block flow diagram for the operation of the cryocooler of FIG. 1;

FIGS. 6A–6C are graphs of PV cooling power wherein most of the cooling power is allocated to the first-stage Stirling expander (FIG. 6A), the cooling power is balanced between the two stages (FIG. 6B), and most of the cooling power is allocated to the second-stage pulse tube expander (FIG. 6C)

DETAILED DESCRIPTION OF THE INVENTION

Figure 1:
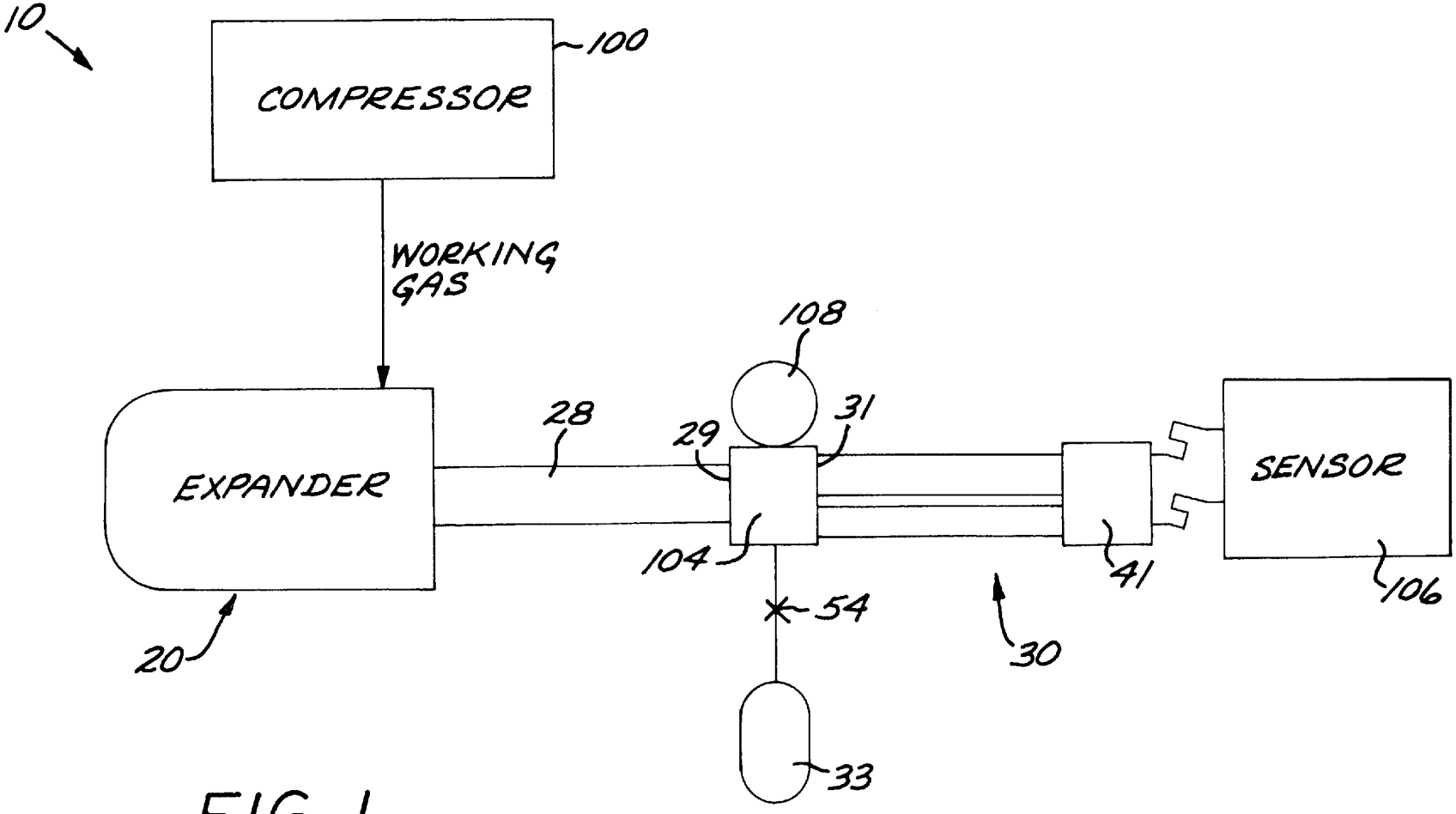
FIG. 1 is a schematic illustration of the cryocooler.

FIG. 1 generally illustrates a two-stage cryocooler 10, also termed a two-stage expander. The two-stage cryocooler 10 includes a first-stage Stirling expander 20 and a second-stage pulse tube expander 30. The structure and operation of the first-stage Stirling expander 20 and the second stage pulse tube expander 30 will be discussed in greater detail subsequently. A compressor 100 supplies a compressed working gas, such as helium, to the first-stage Stirling expander 20. The working gas is expanded into an expansion volume 28. The working gas flows from the expansion volume 28 through a Stirling expander outlet 29, and into a pulse tube inlet 36 of the second-stage pulse tube expander 30. A first-stage interface 104 between the first-stage Stirling expander 20 and the second-stage pulse tube expander 30 will be discussed in more detail subsequently. A second-stage thermal interface 41 is provided between the second-stage pulse tube expander 30 and a heat load in the form of a component to be cooled, here indicated as a sensor 106.

A key feature is a thermal-energy storage device 108 in thermal communication with the first-stage interface 104. The thermal-energy storage device 108 absorbs excess heat from the first-stage interface 104 when the first-stage Stirling expander 20 is operated such that it cannot remove all of the heat necessary to cool the first-stage interface 104. As will be discussed, this circumstance occurs when a high heat flux is introduced into the second-stage thermal interface 41, and the system is operated so that cooling (refrigeration) power is preferentially allocated into the second-stage pulse tube expander 30. The thermal energy storage device 108 may be of any operable type, but is preferably one where energy is absorbed and released through a phase change of a material. Heat is absorbed when the working fluid is heated to the gaseous state, and released when the working fluid is cooled to the solid or liquid states. The thermal-energy storage device 108 is preferably a triple-point cooler of the type known in the art for use in other applications. The working fluid for the triple point cooler is preferably nitrogen, argon, methane, or neon.

Figure 2:
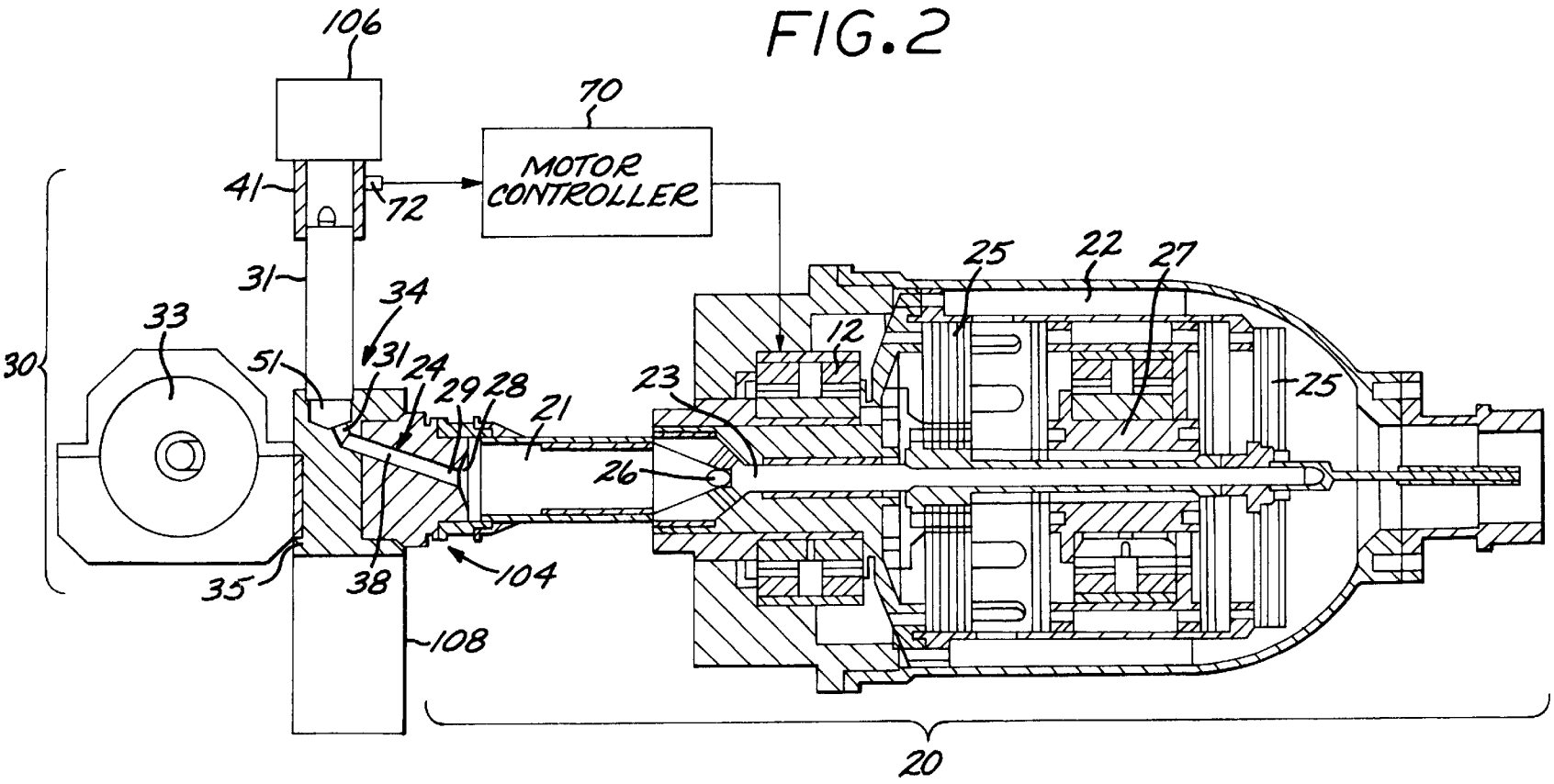
FIG. 2 is a schematic view of the cryocooler, with the first-stage Stirling expander in section.
Figure 3:
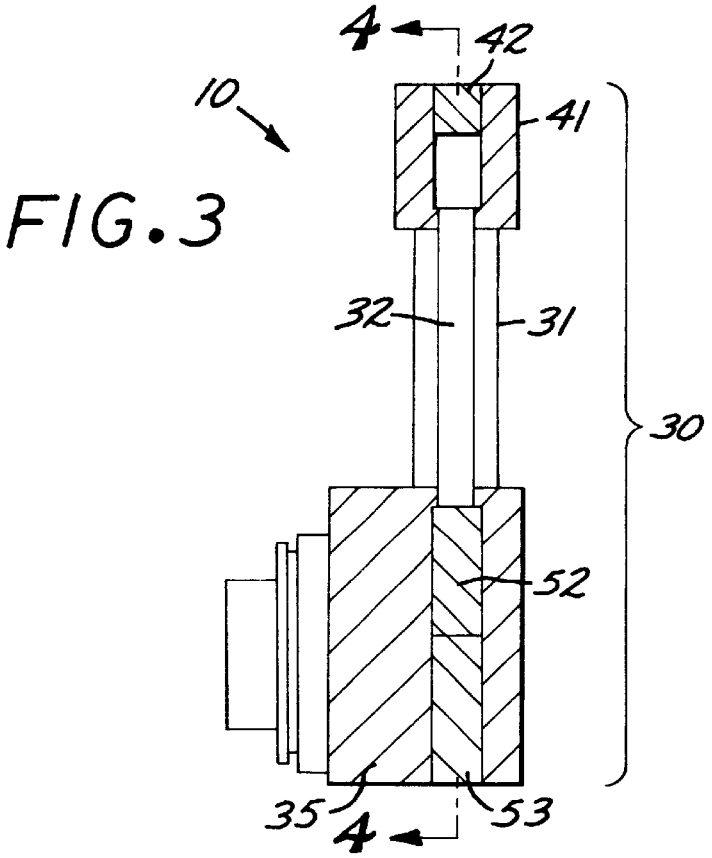
FIG. 3 is a schematic sectional view of the pulse tube expander.
Figure 4:
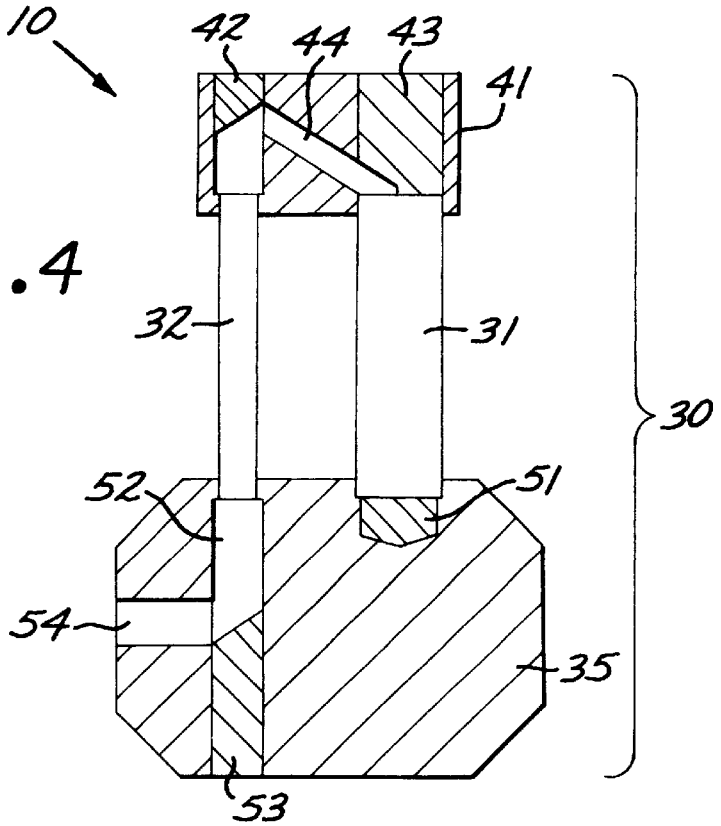
FIG. 4 is a schematic sectional view of the pulse tube expander, taken along line 4—4 of FIG. 3.

FIGS. 2–4 illustrate the working elements of the two-stage cryocooler 10 in greater detail. The first-stage Stirling expander 20 of the exemplary hybrid two-stage cryocooler 10 comprises the flexure-mounted Stirling expander 20. The Stirling expander 20 has a plenum 22 and a cold head comprising a thin-walled cold cylinder, an expander inlet 26 disposed at a warm end of the expansion volume 28, a moveable piston or displacer 23 disposed within the expansion volume 28, and a first-stage regenerator 21 and heat exchanger 24.

The displacer 23 is suspended on fore and aft flexures 25. The displacer 23 is controlled and moved by means of a motor 12 located at a fore end of the plenum 22. A flexure-suspended balancer 27 may be used to provide internal reaction against the inertia of the moving displacer 23.

The second-stage pulse tube expander 30 comprises a second-stage regenerator (regenerative heat exchanger) 31, a pulse tube 32, a phase-angle control orifice, and a surge volume 33. The pulse tube 32 is coupled at one end to the second-stage thermal interface 41. The second-stage thermal interface 41 has a first end cap 42 that seals the pulse tube gas column 32, a second end cap 43 that seals the second-stage regenerator 31. A second-stage heat exchanger 44 is provided in the second-stage thermal interface 41 that is coupled between the pulse tube 32 and the second-stage regenerator 31.

A flow-through heat exchanger 34 is disposed at a thermal interface 35 between the first-stage Stirling expander 20 and the second-stage pulse tube inlet heat exchanger 51 and a pulse-tube outlet heat exchanger 52. The working gas flows along a gas flow path 38 extending between the Sterling expander outlet 29 and the pulse tube inlet 36. The heat exchanger 24 is in thermal contact with the gas flow path 38. A third end cap 53 seals the end of the gas column of the pulse tube 32 in the flow-through heat exchanger 34. A port 54 is disposed in the flow-through heat exchanger 34 that is coupled to the surge volume 33 and serves as the phase-angle control orifice.

In the hybrid two-stage cryocooler 10, a working gas such as helium, for example, flows into the expander inlet 26 and into the first-stage regenerator 21 and heat exchanger 24. Gas flowing into the cold volume within the first-stage Stirling expander 20 is regenerated by the first-stage regenerator 21 and heat exchanger 24. A portion of the gas remains in the first-stage expansion volume between the first-stage regenerator 21 and the heat exchanger 24. Progressively smaller portions of the gas continue to the second-stage regenerator 31, the pulse tube 32, and the surge volume 33. The gas return flow follows the same path in reverse.

A significant advantage of the hybrid two-stage cryocooler 10, compared with other multistage expanders, is the ease of shifting refrigerating power between the two stages 20, 30. This is accomplished by varying the stroke and/or phase angle of the displacer 23 in the Stirling first-stage expander 20 and by means of the port 54 (phase-angle control orifice), which alters mass flow distribution into the surge volume 33. This additional degree of control enables performance optimization at any operating point, including on orbit in the actual thermal environment of a spacecraft, for example. This feature provides for power savings when using the hybrid two-stage cryocooler 10.

The first-stage Stirling expander 20 has high thermodynamic efficiency when removing the majority of the heat load from gas within the two-stage cryocooler 10. The second-stage pulse tube expander 30 provides additional refrigeration capacity and improved power efficiency. The second-stage pulse tube expander 30 adds little additional manufacturing complexity because of its simplicity, in that it has no moving parts.

The flow-through heat exchanger 34 at the thermal interface 35 between the first-stage and second-stage expanders 20, 30 significantly improves first-stage efficiency (relative to conventional single-stage Stirling expanders) by virtue of the improved heat transfer coefficient at the thermal interface therebetween. The Stirling expander 20 reduces the total dead volume of the hybrid expander 10 compared to a conventional one-stage or two-stage pulse tube cooler having an equivalent thermodynamic power. The Stirling expander 20 thus reduces mass flow requirements, which reduces the swept volume of the compressor and enables refrigeration to be accomplished with a smaller compressor.

The regenerator pressure drop is relatively small in the hybrid two-stage cryocooler 10 because the pulse tube regenerator 31 operates at a reduced temperature. The gas thus has a higher density and a lower gas viscosity, which results in a lower pressure drop.

A motor controller 70 controls the operation of the motor 12, including at least the stroke of the displacer 23 and the phase angle of the motor. A heat-load sensor 72 is in thermal communication with the sensor 106 and the second-stage pulse tube expander 30, in this case at the second-stage thermal interface 41. The heat-load sensor 72 measures the heat load on the second-stage thermal interface 41 by measuring its temperature. The signal of the heat-flow sensor 72 is used by the motor controller 70 to determine the allocation of cooling power between the first-stage Stirling expander 20 and the second-stage pulse tube expander 30.

FIG. 5 illustrates a preferred approach for cooling a component to be cooled, such as the sensor 106. The cryocooler 10 is provided, numeral 80. The cryocooler 10 is first operated at a steady-state power allocation, numeral 82. The cooling (refrigerating) power is allocated to the first-stage Stirling expander 20 and to the second-stage pulse tube expander 30 so that the required temperature of the sensor 106 is maintained under a steady-state heat load. At a later time, numeral 84, it may be necessary to reallocate the cooling power between the two expanders 20 and 30. It is possible to allocate more cooling power to the first-stage Stirling expander 20 (and thence less cooling power to the second-stage pulse tube expander 30), numeral 86, or to allocate more cooling power to the second-stage pulse tube expander 30 (and thence less cooling power to the first-stage Stirling expander 20), numeral 88.

In a typical case of a temporary increase in the heat load to the second-stage thermal interface 41, step 88 is followed to allocate more cooling power to the second-stage pulse tube expander 30. Because in this period less cooling power is allocated to the first-stage Stirling expander 20, the first-stage Stirling expander 20 cannot keep up with the heat load requirement and tends to fall behind, so that its temperature rises. Excess heat is temporarily stored in the thermal-energy storage device 108, which serves as a surrogate heat sink for the second-stage pulse tube expander 30. At a later time, when the heat load to the second-stage thermal interface 41 has fallen back from the temporary high load to the steady-state level, cooling power is shifted to the first stage, numeral 86, to recover the heat stored in the thermal-energy storage device 108 and prepare it for the next period of high heat loading. When equilibrium is reached, the steady-state cooling power 82 is resumed.

The allocation of cooling power is accomplished by changing the stroke of the displacer 23 (by commanding a variation in the amplitude of the motor 12) or by changing the phase angle of the displacer 23 (by commanding a change in the phase angle of the motor 12). FIGS. 6A–6C schematically illustrate the allocation of cooling power using conventional pressure-volume (PV) diagrams. In FIG. 6A, a comparatively large proportion of the cooling power is allocated to the first-stage Stirling expander 20, and a comparatively small proportion of the cooling power is allocated to the second-stage pulse tube expander 30, corresponding to step 86 of FIG. 5. In FIG. 6C, a comparatively small proportion of the cooling power is allocated to the first-stage Stirling expander 20, and a comparatively large proportion of the cooling power is allocated to the second-stage pulse tube expander 30, corresponding to step 88 of FIG. 5. In FIG. 6B, the proportions of the cooling power are approximately balanced, corresponding to step 82 of FIG. 5.

Figure 7:
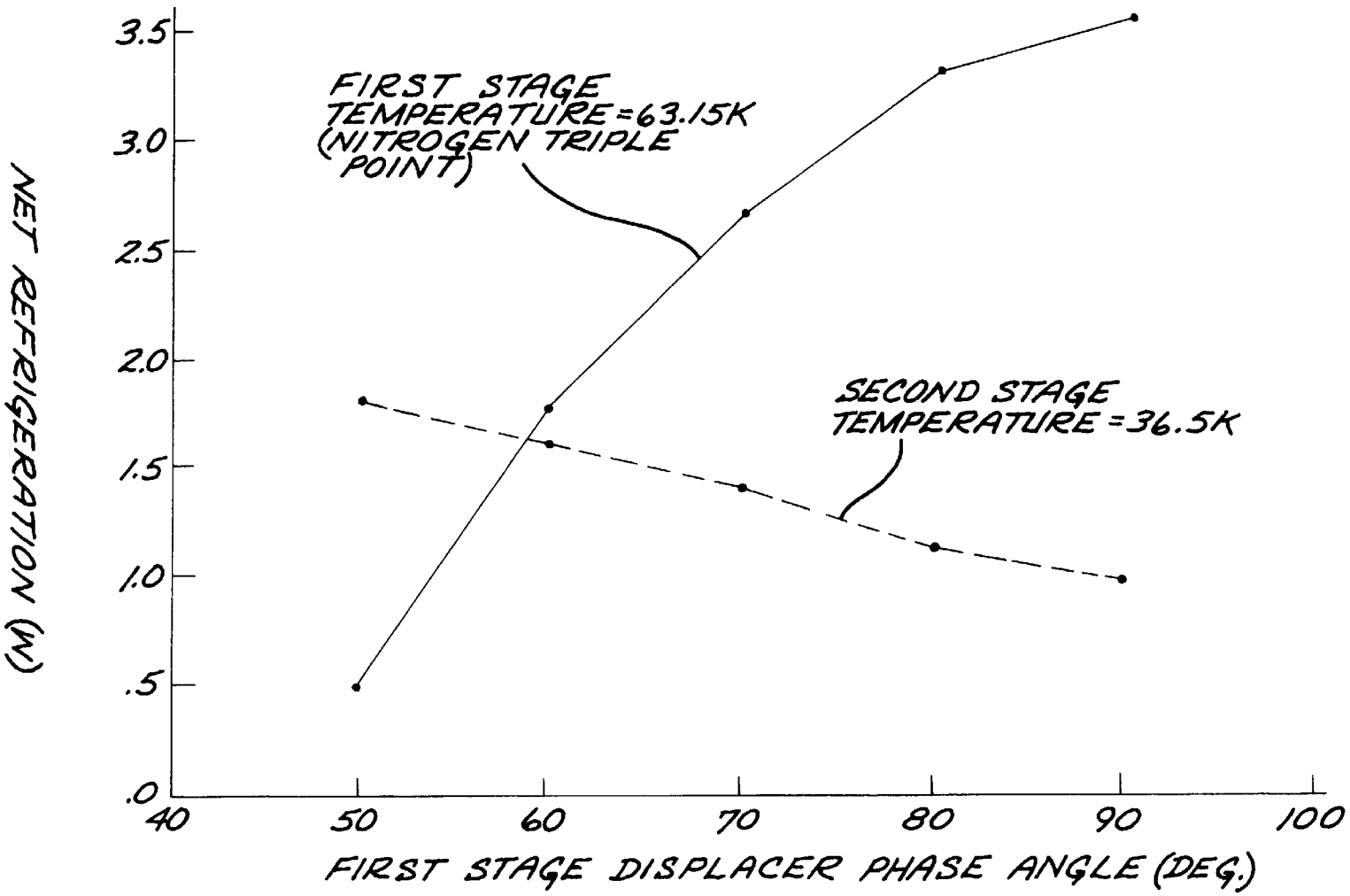
FIG. 7 is a graph presenting the results of a computer simulation of the operation of the cryocooler.

The present approach has been verified with a computer model of the two-stage cryocooler 10, with the results shown in FIG. 7. In the model, the operating phase angle of the displacer 23 of the first-stage Stirling expander 20 was varied from 50 degrees to 90 degrees, and cooling capacity at each of the two stages was computed. FIG. 7 shows the results for a cooler with a 36.5° K. second-stage load and nitrogen triple point thermal-energy storage device 108. As the first stage displacer 23 phase angle decreases from 90 degrees, first-stage refrigeration decreases and second-stage refrigeration increases. In this case, the second-stage refrigeration has been increased by a factor of nearly two while the first-stage refrigeration has decreased by a factor of about seven. This operating condition may be sustained as long as the thermal-energy storage device 108 maintains the required first-stage temperature. When the cooling power of the thermal-energy storage device 108 is exhausted, the phase angle is returned to 90 degrees, first-stage refrigeration is increased by a factor of seven, and the thermal-energy storage device 108 is recharged and is ready for another operating cycle of high heat load. In practice, the thermal-energy storage device 108 is sized to accommodate all thermal fluctuations expected in service.

The hybrid two-stage cryocooler 10 may be used in cryogenic refrigerators adapted for military and commercial applications where high-efficiency refrigeration is required at one or two temperatures. The hybrid two-stage cryocooler 10 is also well suited for use in applications requiring small size, low weight, long life, high reliability, and cost-effective producibility. The hybrid two-stage cryocooler 10 is particularly well suited for use in civil and defense space-based infrared sensors, such as those used in spacecraft infrared sensor systems, and the like.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A hybrid two-stage cryocooler comprising:

a first-stage Stirling expander having a first-stage interface and a Stirling expander outlet;

a thermal-energy storage device in thermal communication with first-stage interface;

a second-stage pulse tube expander having a pulse tube inlet;

a gas flow path extending between the Stirling expander outlet and the pulse tube inlet; and a heat exchanger in thermal contact with the gas flow path.

2. The cryocooler of claim 1, wherein the thermal-energy storage device comprises a triple-point cooler.

3. The cryocooler of claim 1, wherein the thermal-energy storage device comprises a triple-point cooler utilizing a working fluid selected from the group consisting of nitrogen, argon, methane, and neon.

4. The cryocooler of claim 1, wherein the first-stage Stirling expander comprises an expansion volume having an expander inlet and the Stirling expander outlet, a displacer which forces a working gas through the expander inlet and a first-stage regenerator, into the expansion volume, and thence into the gas flow path, and a motor that drives the displacer.

5. The cryocooler of claim 4, further including a motor controller for the motor, the motor controller being operable to alter at least one of the stroke and the phase angle of the motor.

6. The cryocooler of claim 5, further including a heat-load sensor, and wherein the motor controller is responsive to a control signal of the heat-load sensor.

7. The cryocooler of claim 1, wherein the pulse tube expander comprises a pulse tube inlet, a pulse tube gas volume in gaseous communication with the pulse tube inlet, the gas volume including a second-stage regenerator, a pulse tube gas column, and a surge volume, and a second-stage heat exchanger in thermal communication with the second-stage regenerator and the pulse tube gas column.

8. A hybrid two stage cryocooler comprising:

a first-stage Stirling expander comprising an expansion volume having an expander inlet, a first-stage regenerator, and an outlet, and a displacer which forces a working gas through the expander inlet and the first-stage regenerator, and into the expansion volume;

a thermal-energy storage device in thermal communication with the expansion volume of the first-stage Stirling expander;

a second-stage pulse tube expander comprising a pulse tube inlet, a pulse tube gas volume in gaseous communication with the pulse tube inlet, the gas volume including a second-stage regenerator, a pulse tube gas column, and a surge volume, and a second-stage heat exchanger in thermal communication with the second-stage regenerator and the pulse tube gas column;

the gas flow path establishing gaseous communication between the outlet of the expansion volume of the Stirling expander and the pulse tube inlet, and a flow-through heat exchanger disposed along the gas flow path between the output of the expansion volume of the Stirling expander and the pulse tube inlet.

9. The cryocooler of claim 8, wherein the thermal-energy storage device comprises a triple-point cooler.

10. The cryocooler of claim 8, wherein the thermal-energy storage device comprises a triple-point cooler utilizing a working fluid selected from the group consisting of nitrogen, argon, methane, and neon.

11. The cryocooler of claim 8, wherein the first-stage Stirling expander further comprises a motor that drives the displacer.

12. The cryocooler of claim 11, further including a motor controller for the motor, the motor controller being operable to alter at least one of an amplitude and a phase angle of the motor.

13. The cryocooler of claim 12, further including a heat load in thermal communication with the second-stage pulse tube expander, and a heat-load sensor in thermal communication with the heat load; and wherein the motor controller is responsive to a control signal of the heat-load sensor.

14. The cryocooler of claim 8, wherein the pulse tube expander comprises a pulse tube inlet, a pulse tube gas volume in gaseous communication with the pulse tube inlet, the gas volume including a second-stage regenerator, a pulse tube gas column, and a surge volume, and a second-stage heat exchanger in thermal communication with the second-stage regenerator and the pulse tube gas column.

15. A method for cooling a heat load, comprising the steps of providing a cryocooler comprising a first-stage Stirling expander having a first-stage interface, a displacer, a first-stage regenerator, a motor that drives the displacer, and a Stirling expander outlet, a thermal-energy storage device in thermal communication with first-stage interface, a second-stage pulse tube expander having a pulse tube inlet, the second-stage pulse tube expander being in thermal contact with the heat load;

a motor controller for the motor of the first-stage Stirling expander, the motor controller being operable to vary a relative cooling power of the first-stage Stirling expander and the second-stage pulse tube expander, a gas flow path extending between the Stirling expander outlet and the pulse tube inlet, and a heat exchanger in thermal contact with the gas flow path;

operating the motor controller to increase the relative cooling power of the second-stage pulse tube expander for a large heat load, and thereafter to decrease the relative cooling power of the second-stage pulse tube expander.

* * * * *